US007278729B2

(12) United States Patent
Nakajima

(10) Patent No.: US 7,278,729 B2
(45) Date of Patent: Oct. 9, 2007

(54) IMAGE RECORDING APPARATUS AND IMAGE RECORDING METHOD

(75) Inventor: Atsushi Nakajima, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 270 days.

(21) Appl. No.: 10/804,433

(22) Filed: Mar. 19, 2004

(65) Prior Publication Data

US 2004/0189728 A1 Sep. 30, 2004

(30) Foreign Application Priority Data

Mar. 31, 2003 (JP) ..... 2003-095470
Feb. 5, 2004 (JP) ..... 2004-029431

(51) Int. Cl.
*B41J 2/01* (2006.01)

(52) U.S. Cl. ..... 347/102; 347/40; 347/42

(58) Field of Classification Search ..... 347/102, 347/40, 41, 42

See application file for complete search history.

(56) References Cited

U.S. PATENT DOCUMENTS

| | | | | |
|---|---|---|---|---|
| 5,739,828 | A * | 4/1998 | Moriyama et al. | 347/9 |
| 6,874,881 | B2 * | 4/2005 | Suzuki et al. | 347/100 |
| 2003/0035037 | A1 * | 2/2003 | Mills et al. | 347/102 |
| 2003/0164866 | A1 * | 9/2003 | Hoisington et al. | 347/11 |
| 2004/0189770 | A1 * | 9/2004 | Hintermann | 347/102 |

* cited by examiner

*Primary Examiner*—Stephen Meier
*Assistant Examiner*—Ly T. Tran
(74) *Attorney, Agent, or Firm*—Lucas & Mercanti, LLP

(57) ABSTRACT

An image recording apparatus having: a recording head of an ink jet system for jetting an ultraviolet curable ink on a recording medium to form an image; and an irradiation device for radiating an ultraviolet ray to the ink placed on the recording medium to cure and fix the ink, wherein the apparatus has a plurality of recording modes with different image recording speeds for changing a maximum amount of ink to be jetted corresponding to the plurality of recording modes.

6 Claims, 7 Drawing Sheets

SERIAL PRINT TYPE

LINE HEAD TYPE

FLAT BED TYPE

FIG.4

| INK TYPE | INK COMPOSITION(% BY MASS) | | | | | |
|---|---|---|---|---|---|---|
| | COLOR MATERIAL | | PHOTO POLYMERIZABLE COMPOUND | | | INITIATOR |
| | | | EPOXY COMPOUND | OXETANE COMPOUND | | |
| | TYPE | ADDITION AMOUNT | CELOXIDE2021P | OXT-221 | OXT-212 | SP152 |
| K | COLOR MATERIAL 1 | 5.0 | 15.0 | 40.0 | 35.0 | 5.0 |
| C | COLOR MATERIAL 2 | 2.5 | 17.5 | 45.0 | 30.0 | 5.0 |
| M | COLOR MATERIAL 3 | 3.0 | 17.0 | 45.0 | 30.0 | 5.0 |
| Y | COLOR MATERIAL 4 | 2.5 | 17.5 | 45.0 | 30.0 | 5.0 |

FIG. 5

| RECORDING CONDITION | RESOLUSION (dpi) | NUMBER OF PASS | AMOUNT OF INK DROPLET (pl/pixel) | LIMIT AMOUNT OF INK | MAXIMUM AMOUNT OF INK ADHESION (4 COLORS SOLID AREA $ml/m^2$) | CARRIAGE SPEED (mm/s) | INK BLURRING | ADHESIVENESS TO BASE MATERIAL | WRINKLE |
|---|---|---|---|---|---|---|---|---|---|
| 1 | 720 | 8 | 8 | 400% | 23.6 | 280 | A | A | A |
| 2 | 720 | 8 | 12 | 400% | 35.4 | 280 | B | C | C |
| 3 | 720 | 8 | 12 | 250% | 22.1 | 280 | A | A | A |
| 4 | 720 | 4 | 8 | 400% | 23.6 | 280 | B | C | C |
| 5 | 720 | 4 | 8 | 250% | 14.8 | 280 | A | B | A |
| 6 | 360 | 4 | 28 | 400% | 22.4 | 95 | A | A | A |
| 7 | 360 | 2 | 28 | 400% | 22.4 | 95 | C | C | C |
| 8 | 360 | 2 | 28 | 300% | 16.8 | 95 | B | A | A |

FIG.6

| RECORDING CONDITION | RESOLUSION (dpi) | NUMBER OF PASS | AMOUNT OF INK DROPLET (pl/pixel) | LIMIT AMOUNT OF INK | MAXIMUM AMOUNT OF INK ADHESION (4 COLORS SOLID AREA $ml/m^2$) | CARRIAGE SPEED (mm/s) | INK BLURRING | ADHESIVENESS TO BASE MATERIAL | WRINKLE |
|---|---|---|---|---|---|---|---|---|---|
| 1B | 360 | 1 | 28 | 400% | 22.4 | 200 | B | A | A |
| 2B | 360 | 1 | 28 | 400% | 22.4 | 300 | C | C | C |
| 3B | 360 | 1 | 28 | 250% | 14 | 300 | A | A | A |

*FIG. 7*

| RECORDING CONDITION | RESOLUSION (dpi) | NUMBER OF PASS | AMOUNT OF INK DROPLET (pl/pixel) | LIMIT AMOUNT OF INK | MAXIMUM AMOUNT OF INK ADHESION (4 COLORS SOLID AREA $ml/m^2$) | CARRIAGE SPEED (mm/s) | INK BLURRING | ADHESIVENESS TO BASE MATERIAL | WRINKLE |
|---|---|---|---|---|---|---|---|---|---|
| 1C | 720 | 8 | 28 | 400% | 35.4 | 200 | B | A | A |
| 2C | 720 | 4 | 28 | 400% | 35.4 | 200 | C | C | C |
| 3C | 720 | 4 | 28 | 250% | 22.1 | 200 | A | A | A |

IMAGE RECORDING APPARATUS AND IMAGE RECORDING METHOD

BACKGROUND OF THE INVENTION

1. Field of the Invention

The present invention relates to an image recording apparatus and an image recording method and, more particularly, to an image recording apparatus and an image recording method for fixing an image on a recording medium by radiating an ultraviolet-ray.

2. Description of the Related Art

As a system for recording an image to an recording medium having no particular image reception layer, UV (ultraviolet) ink jet recording system which uses UV curable ink has been known, in which a recording medium is irradiated with UV-rays after the UV curable ink was jetted thereon to cure and fix the UV curable ink, thereby recording an image on the recording medium (see, for example, JP-Tokukaihei-6-200204A and JP-Tokukai-2000-504778A). Since the UV curable ink is fixed on a recording medium which is not specially treated, an image can be recorded on various types of recording medium. A recording medium containing no chemical compound inhibiting ink curing with-UV-rays, such as a printing paper, copy paper, synthetic paper, various types of plastic films, various metals, wood, glass, various cloths or the like, can be employed in the UV ink jet recording system.

In the ink jet recording system, a plurality of recording modes each having an image recording speed which is different from others are provided to be able to select a recording mode according to a type of recording medium or a demanding image quality. For example, in the case that a positional relationship between a recording head and a UV irradiation device is fixed such as an image recording apparatus of serial print type in which the recording head of the ink jet system and the UV irradiation device are mounted on a same carriage, the exposure condition is changed by changing a recording mode. To put it concretely, when a recording mode is changed to increase an image recording speed, factors such as timing from jetting ink to exposure, exposure time, exposure record of base ink at a portion on which ink is reprinted is changed, causing irregularity of an image quality and ink curing property.

It is effective to appropriately change the arrangement of the irradiation device and the recording head, illuminance of a light source, a light emitting area of a light source and irradiation time to stabilize these properties corresponding to a recording mode, however, a specific contrivance is required for the apparatus.

In the serial print type in which the recording head of ink jet system and the light source are mounted on the same carriage, it is preferable to use a small and lightweight light source as far as possible for minimizing the size of the carriage. Since the output of a small light source has a limit, the ink may not be cured enough, particularly, in the case of using an apparatus in which an amount of ink jetted per unit of time is large.

Moreover, in a process color printing of yellow (Y), magenta (M), cyan (C), and black (Bk), since the surface of ink is not cured enough at a portion where the amount of ink is large, an image blurs. Even when the surface of the ink can be cured enough, a problem occurs that the ink is not cured enough inside thereof, causing a deterioration of adhesiveness to a substrate and wrinkles by ink shrinkage on the surface.

SUMMARY OF THE INVENTION

An object of the present invention is to provide an image recording apparatus and an image recording method in which a good ink curing property can be obtained without making a complicated change of exposure condition.

In order to attain the above described object, in accordance with a first aspect of the present invention, the image recording apparatus of the present invention comprises:

a recording head of an ink jet system for jetting an ultraviolet curable ink on a recording medium to form an image; and an irradiation device for radiating an ultraviolet ray to the ink placed on the recording medium to cure and fix the ink, wherein the apparatus has a plurality of recording modes with different image recording speeds for changing a maximum amount of ink to be jetted corresponding to the plurality of recording modes.

According to the apparatus of the present invention, the maximum amount of ink to be jetted can be appropriately changed corresponding to the plurality of recording modes, so that, for example, a total amount of ink is limited for a recording mode with a high image recording speed in comparison to the normal speed, thereby a sufficient ink curing property can be obtained with a small amount of light irradiation without decreasing the image recording speed.

Thus, the image recording apparatus which can obtain a high quality image can be realized.

Preferably, in the apparatus of the first aspect of the present invention, the maximum amount of ink to be jetted is decreased for a recording mode with a high image recording speed, and the maximum amount of ink to be jetted is increased for a recording mode with a low image recording speed, in the plurality of recording modes.

According to the apparatus of the present invention, in the plurality of recording modes, the maximum amount of ink to be jetted is decreased for a recording mode with a high image recording speed, and the maximum amount of ink to be jetted is increased for a recording mode with a low image recording speed. Therefore, the operations and effects of the first aspect of the present invention can be realized more certainly.

Preferably, in the apparatus of the first aspect of the present invention, a recording type is a serial print type in which the recording head of the ink jet system and the irradiation device for radiating an ultraviolet ray are mounted on a same carriage.

According to the apparatus of the present invention, even when the irradiation device has to be small such as in the case of the serial print type in which the recording head of the ink jet system and the ultraviolet ray irradiation device are mounted on the same carriage, because the maximum amount of ink to be jetted can be appropriately changed corresponding to the plurality of recording modes with different recording speeds, a sufficient ink curing property can be obtained with a small amount of light irradiation without decreasing the image recording speed by limiting the total amount of ink for a recording mode with a high recording speed in comparison to the normal speed.

Preferably, in the apparatus of the first aspect of the present invention, a recording type is a line print type.

According to the apparatus of the present invention, the maximum amount of ink to be jetted can be appropriately changed corresponding to the plurality of recording modes with different recording speeds even in the case of the line print type, so that for a recording mode with a high recording speed in comparison to the normal speed, a sufficient ink curing property can be obtained with a small amount of light irradiation without decreasing the image recording speed by limiting the total amount of ink.

Preferably, in the apparatus of the first aspect of the present invention, a recording type is a flat bed print type.

According to the apparatus of the present invention, even when the irradiation device has to be small such as in the case of the line bed print type in which the recording head of the ink jet system and the ultraviolet ray irradiation device are mounted on the same carriage, because the maximum amount of ink to be jetted can be appropriately changed corresponding to the plurality of recording modes with different recording speeds, a sufficient ink curing property can be obtained with a small amount of light irradiation without decreasing the image recording speed by limiting the total amount of ink for a recording mode with a high recording speed in comparison to the normal speed.

Preferably, in the apparatus of the first aspect of the present invention, the apparatus comprises: four or more recording heads for forming an image by jetting four colors of inks of yellow, magenta, cyan, and black, wherein a total amount of ink to be jetted of a single color or a plurality of colors necessary for forming an image by jetting the ink from the plurality of recording heads so as to generate almost no gap on the recording medium is 5 $g/m^2$ or more, and the total amount of ink to be jetted is set to be 5 $g/m^2$ or more and a ratio of amounts of inks of individual colors to be jetted is set, corresponding to the plurality of recording modes.

According to the apparatus of the present invention, in the case of setting the total amount of ink to be jetted to be 5 $g/m^2$ or more and a ratio of amounts of inks of individual colors to be jetted is set, corresponding to the recording modes, for example, for a recording mode with a high recording speed, the total amount of ink to be jetted is reduced in comparison to a recording mode with a low recording speed, and the ratio of amounts of inks to be jetted is also changed. Therefore, a sufficient ink curing property can be obtained with a small amount of light irradiation, enabling to improve ink blur, adhesiveness to a substrate, to suppress wrinkle generation, or the like even in a recording mode with a high recording speed.

In accordance with a second aspect of the present invention, the image recording method of the present invention comprises:

forming an image by jetting an ultraviolet curable ink on a recording medium from a recording head of an ink jet system; thereafter radiating an ultraviolet ray to the ink placed on the recording medium by an irradiation device to cure and fix the ink; and changing a maximum amount of ink to be jetted corresponding to a plurality of recording modes with different image recording speeds.

According to the image recording method a second aspect of the present invention, the operations and effects of the first aspect of the present invention can be realized.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein;

FIG. 4 is a table showing compositions of ink used in examples for the image recording apparatus according to the embodiment;

FIG. 5 is a table showing recording conditions and results of the first example of the image recording apparatus of a serial print type according to the embodiment;

FIG. 6 is a table showing recording conditions and results of the second example of the image recording apparatus of a line print type.

FIG. 7 is a table showing recording conditions and results of the third example of the image recording apparatus of a flat bed print type.

DETAILED DESCRIPTION OF THE PREFERRED EMBODIMENTS

An embodiment of the present invention will be explained referring to FIGS. 1 to 7.

Figure 1:
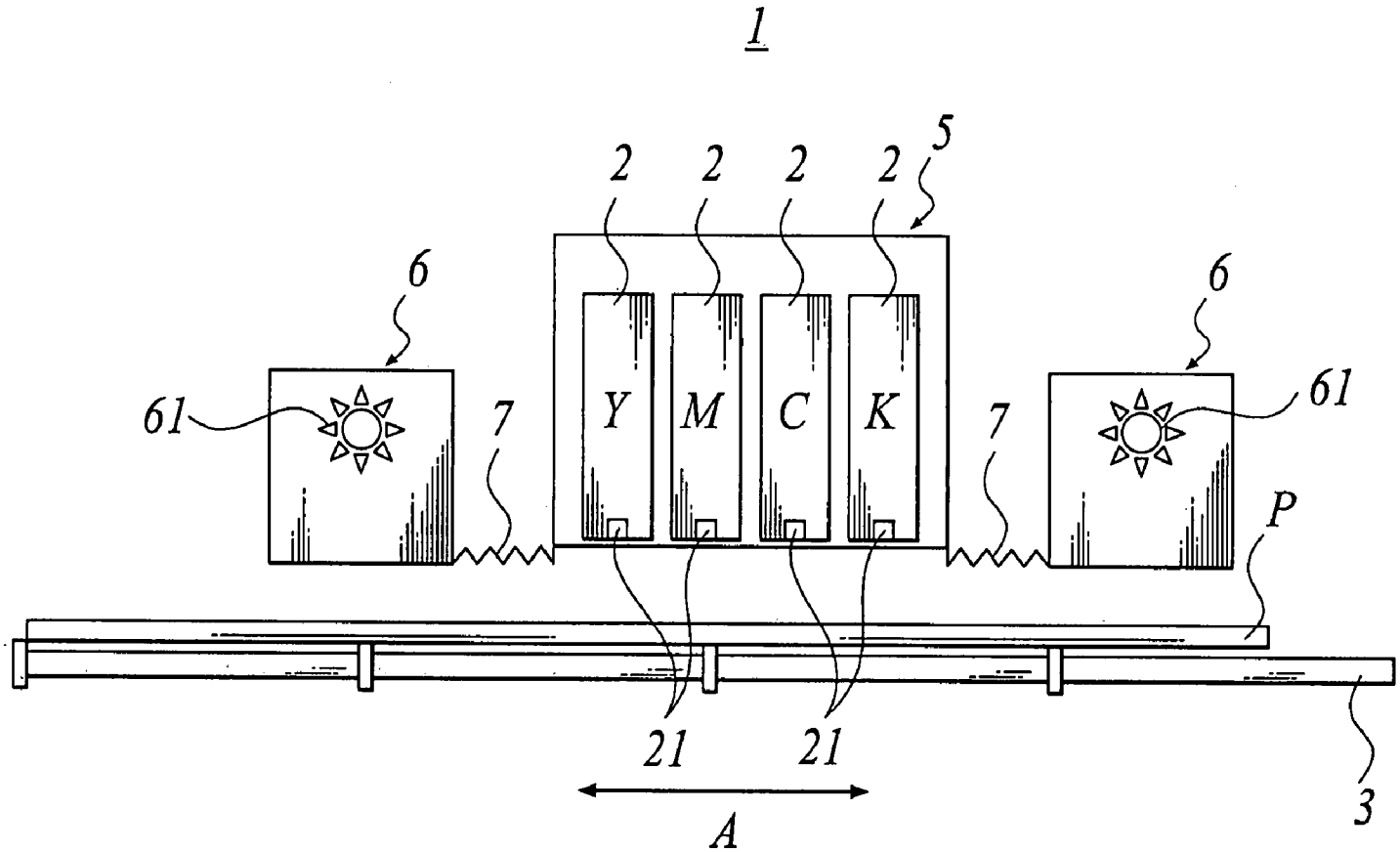
FIG. 1 is a schematic view showing an overall configuration of an image recording apparatus of a serial print type according to the present embodiment.

FIG. 1 is a front view showing a main configuration of an image recording apparatus 1, which is a serial type ink jet recording apparatus in which an image is formed using ultraviolet-ray (UV-ray) curable ink while scanning a recording head 2 in a direction perpendicular to a carrying direction of a recording medium P. As shown in FIG. 1, the image recording apparatus 1 comprises a platen 3 for supporting the recording medium P from below. The recording medium P supported by the platen 3 is adapted to be carried by a carrying device which is not shown.

Any one of a nonabsorbent and an absorbent recording medium can be employed as the recording medium P. The term of nonabsorbent indicates that the recording medium P does not absorb any ink compound (hereinafter simply named "ink"), however, in the present invention, when the amount of transferring ink in Bristow method was less than 0.1 $ml/mm^2$, a recording medium on which practically 0 $ml/mm^2$ of ink was transferred is denoted as the nonabsorbent recording medium. Other recording media are denoted as the absorbent recording medium.

As the nonabsorbent recording medium, for example, various types of nonabsorbent plastics and films thereof used for so-called flexible packaging can be employed in addition to a normal non-coated paper, coated paper or the like. As the various types of nonabsorbent plastics, a PET film, OPS film, OPP film, ONy film, PE film, TAC film or the like can be applied, and in addition, for example, polycarbonate, acrylate resin, ABS resin, polyacetal, PVA, various rubbers or the like is also applied as a plastic. Preferably, the nonabsorbent plastic has a surface energy in the range of 35 mN/m to 60 mN/m, and more preferably in the range of 40 mN/m to 60 mN/m.

As the absorbent recording medium, for example, a plane paper (copy paper), woodfree paper or the like can be applied.

A pair of guide rail (not shown) which extends in a direction (scanning direction A) perpendicular to the carrying direction of the recording medium P is provided above the platen 3. The carriage 5 is supported by the guide rail reciprocably in the scanning direction A.

The carriage 5 is provided with a plurality of serial type recording heads 2 for jetting each color of inks (Y: yellow, M: magenta, C: cyan, K: black). The recording heads 2 are mounted to make ink jetting surfaces 21 face the recording medium P supported by the platen 3. Each recording head 2 is provided with an ink heater 22 (refer to FIG. 2) inside thereof, the ink heater 22 heating ink to control temperature. A plurality of nozzles are arranged in line along the carrying direction of the recording medium P in the ink jetting surface 21 of each recording head 2, and the amount of an ink droplet jetted therefrom is set to be 4 to 80 pl. By controlling the amount of the ink droplet to be jetted on a pixel, a total ink film thickness jetted and fixed on the recording medium can be arbitrary adjusted. As a preferred embodiment, by adjusting the maximum ink film thickness per color in the range of 4 to 20 μm, the total ink film thickness can be within the range of 8 to 60 μm, thereby preventing changes of the image quality on the whole recording medium P. The total ink film thickness indicates the maximum value of film thickness of ink jetted on the recording medium P, and is interpreted to have the same meaning in any case of performing recording by the ink jet system with a single color, two color layers (second color), three color layers or four color layers (based on white color ink).

The image recording apparatus 1 has a plurality of recording modes each having an image recording speed different from others, so that it can arbitrary change the maximum amount of ink to be jetted according to the recording mode. In the embodiment, the recording heads 2 are configured such that each recording head 2 can jet a plurality size of ink droplets according to signals from a control device.

The total amount of ink to be jetted of a single color or a plurality of colors necessary for forming an image by jetting ink from the plurality of recording heads so as to generate almost no gap on the recording medium, that is, for forming a solid image is 5 $g/m^2$ or more. Particularly, in the embodiment, when a solid ink amount is 720 dpl, the total amount of ink to be jetted is set to be 5.9 $g/cm^2$ or more, and when a solid ink amount is 360 dpl, the total amount of ink to be jetted is set to be 5.6 $g/cm^2$ or more.

The total amount of ink to be jetted is set to be an appropriate amount of 5 $g/m^2$ or more and a ratio of amounts of inks of individual colors to be jetted may be set, corresponding to the recording modes.

An irradiation device 6 is provided through a light shielding member 7 on each side of the recording heads 2 on the carriage 5 for curing ink jetted on the recording medium P. Each irradiation device 6 is provided with a light source 61 for irradiating the recording medium P with light. That is, in both of back and forth movements of the carriage 5 in the scanning operation, one of the light sources 6 is always positioned on a downstream side of the recording heads 2 in the scanning direction A. Thus, even when the ink is jetted from the recording heads 2 onto the recording medium P during scanning in any one of the back and forth movements, the ink can be irradiated with light immediately after being jetted. Another irradiation device may be provided to accelerate curing reaction by the second exposure after the whole ink for forming an image is jetted.

As the light source 6, various types of light sources can be applied to radiate UV-rays, electron beams, X-rays, visible light, infrared light or the like. In view of the curing property, cost or the like, it is preferable to use a light source which radiates UV-rays, such as a fluorescent, a mercury lamp, a metal halide lamp, LED or the like. Also, it is preferable that the irradiation device 6 has a shape capable of changing irradiation intensity (mW) of light from the light source.

A main control device in the image recording apparatus 1 will be explained referring to FIG. 2.

Figure 2:
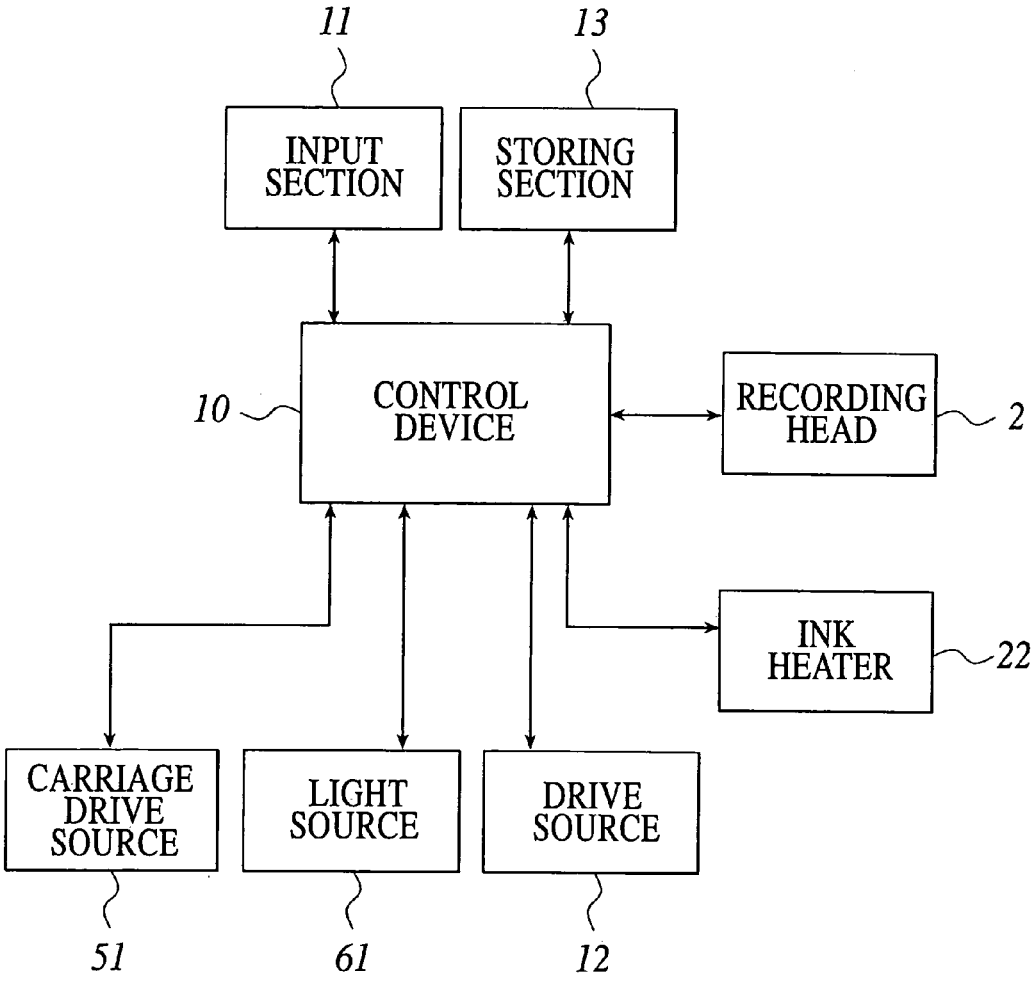
FIG. 2 is a block diagram showing a main control device portion of the image recording apparatus in FIG. 1.

FIG. 2 is a block diagram showing the main control device in the image recording apparatus 1.

As shown in FIG. 2, the image recording apparatus 1 is provided with a control device 10 for controlling each driving section. The control device 10 is electrically connected to an input section 11 in which instructions for forming an image are input, a drive source 12 of the carrying device, a carriage drive source 51 of the carriage 5, an ink heater 22, a storing section 13, the recording heads 2 and the light sources 61. Each driving section of the image recording apparatus 1 is also connected to the control device 10.

The control device 10 is adapted to control each section according to a control program or control data written in the storing section 13 based on the instructions from the input section 11.

The storing section 13 stores programs necessary for image forming operations as well as jetting conditions and irradiation conditions for each type of recording medium P which may be used for the image recording apparatus 1.

The jet conditions denote various parameters such as a limit amount of ink, temperature or the like of each recording head 2 to make a dot diameter and a dot shape of cured ink be constant even when a image recording speed is different.

The limit amount of ink denotes a limit value of ink amount jetted per pixel from the all recording heads 2 based on the total input signals to all colors. For example, when comparing a case of the high image recording speed with a case of the low image recording speed, the limit amount of ink is needed to be suppressed in the case of the high image recording speed in comparison with the case of the low image recording speed, in view of the irradiation time of UV-rays.

The temperature of ink when being jet is preferably at least in the range of 35° C. to 100° C. for stably jetting ink. The control range of the ink temperature is set to ±5° C. of the preset temperature, preferably to ±2° C., and more preferably to ±1° C.

The irradiation start time denotes from the time the ink was jetted on the recording medium P to the time UV-rays are radiated. The irradiation start time is preferably set to be long for the case of using the nonabsorbent recording medium in comparison with the case of using the absorbent recording medium. To put it concretely, for the nonabsorbent recording medium, the irradiation start time is preferably in the range of 0.001 to 0.6 sec, and for the absorbent recording medium, the irradiation start time is preferably in the range of 0.01 to 2 sec.

In practice, for the jetting conditions and the irradiation conditions, appropriate parameters for each recording medium are obtained by judging outputted test patches. These parameters are stored in the storing section 13. For the irradiation start time, appropriate scanning speed of the carriage 5 for each of the nonabsorbent and absorbent recording materials are set such that UV-rays are radiated within the above described range. The scanning speeds are stored in the storing section 13.

The UV curable ink used in the embodiment will be explained. Preferably, the UV curable ink contains at least a polymerizable monomer, a photo initiator or the like.

Preferable examples of the polymerizable monomer include radical polymerizable monomer and cationic polymerizable monomer. Various (meth)acrylate monomers are available for the radical polymerizable monomer, and examples of which include monofunctional monomers such as isoamyl acrylate, stearyl acrylate, lauryl acrylate, octyl acrylate, decyl acrylate, isomyristyl acrylate, isostearyl acrylate, 2-ethylhexyl-diglycol acrylate, 2-hydroxybutyl acrylate, 2-(acryloyloxy)ethyl hexahydrophthalic acid, butoxyethyl acrylate, ethoxydiethylene glycol acrylate, methoxydiethylene glycol acrylate, methoxypolyethylene glycol acrylate, methoxypropylene glycol acrylate, phenoxyethyl acrylate, tetrahydrofurfuryl acrylate, isobornyl acrylate, 2-hydroxyethyl acrylate, 2-hydroxypropyl acrylate, 2-hydroxyethyl acrylate, 2-hydroxypropyl acrylate, 2-hydroxy-3-phenoxypropyl acrylate, 2-acryloyloxyethyl succinic acid, 2-acryloyloxyethyl phthalic acid, 2-acryloyloxyethyl-2-hydroxyethyl phthalic acid, lactone-modified flexible acrylate, t-butylcyclohexyl acrylate or the like; bifunctional monomers such as triethylene glycol diacrylate, tetraethylene glycol diacrylate, polyethylene glycol diacrylate, tripropylene glycol diacrylate, polypropylene glycol diacrylate, 1,4-butanediol acrylate, 1,6-hexanediol diacrylate, 1,9-nonanediol diacrylate, neopentyl glycol diacrylate, dimethylol tricyclodecane diacrylate, EO adduct diacrylate of bisphenol-A, PO adduct diacrylate of bisphenol-A, hydroxypivalic acid neopentyl glycol diacrylate, polytetramethylene glycol diacrylate, or the like; trifunctional or higher functional monomers such as trimethylolpropane triacrylate, EO-modified trimethylolpropane triacrylate, pentaerythritol triacrylate, dipentaerythritol hexaacrylate, di-trimethylolpropane tetraacrylate, glycerin propoxy triacrylate, caprolactone-modified trimethylolpropane acrylate, pentaerythritolethoxy tetraacrylate, caprolactam-modified di-pentaerythritol hexaacrylate or the like.

As the radical polymerizable monomer, it is preferable to use monofunctional, bi-functional, tri-functional and higher-functional monomers in combination. The monofunctional monomer is highly effective in reducing shrinkage ratio of the cured ink, and its low viscosity is more advantageous in obtaining jetting stability during the ink jet recording. The bi-functional monomer has a proper sensitivity and an excellent adhesiveness to a variety of recording media P. The tri-functional or higher-functional monomer is successful in obtaining a desirable sensitivity and film strength after cured. Combined use of these mono-functional, bi-functional, tri-functional and higher-functional monomers successfully prevents curling and waving due to curing shrinkage, improves the adhesiveness and traceability to the recording medium P, and raises the sensitivity. In particular, it is highly effective when applied to a shrinkable film used in such a way that the recording medium P per se is shrunk after image recording.

It is preferable that the monofunctional monomer is used in an amount of 5 to 40% by mass of the entire portion of the ink composition, the bi-functional monomer in an amount of 5 to 40% by mass, and tri-functional or higher-functional monomer in an amount of 5 to 30% by mass. Preferable combination of the polymerizable monomers is such as ensuring difference between the maximum and minimum values of the solubility parameters (SP values) of 1 or above, and more preferably 1.5 or above, in view of improving adhesiveness to a variety of recording media P, and preventing curling caused by curing shrinkage.

Of these monomers, particularly preferable ones in view of avoiding sensitization property, skin irritativeness, eye irritativeness, mutagenicity and toxicity include isoamyl acrylate, stearyl acrylate, lauryl acrylate, octyl acrylate, decyl acrylate, isomyristyl acrylate, isostearyl acrylate, ethoxydiethylene glycol acrylate, methoxypolyethylene glycol acrylate, methoxypropylene glycol acrylate, isobornyl acrylate, lactone-modified flexible acrylate, tetraethylene glycol diacrylate, polyethylene glycol diacrylate, polypropylene glycol diacrylate, EO-modified trimethylolpropane triacrylate, dipentaerythritol hexaacrylate, ditrimethylolpropane tetraacrylate, glycerinpropoxy triacrylate, caprolactone-modified trimethylolpropane triacrylate, pentaerythritolethoxy tetraacrylate, and caprolactam-modified dipentaerythritol hexaacrylate.

Of these, further preferable ones include stearyl acrylate, lauryl acrylate, isostearyl acrylate, ethoxydiethylene glycol acrylate, isobornyl acrylate, tetraethylene glycol diacrylate, EO-modified trimethylolpropane triacrylate, dipentaerythritol hexaacrylate, di-trimethylolpropane tetraacrylate, glycerinpropoxy triacrylate, caprolactone-modified trimethylolpropane triacrylate, and caprolactam-modified dipentaerythritol hexaacrylate.

Any publicly-known cationic polymerizable monomers can be available. Examples of the monomers include epoxide compounds and vinyl ether compounds disclosed in JP-Tokukaihei-6-9714A, JP-Tokukai-2001-31892A, JP-Tokukai-2001-40068A, JP-Tokukai-2001-55507A, JP-Tokukai-2001-310938A, JP-Tokukai-2001-310937A and JP-Tokukai-2001-220526A.

The epoxide compounds are preferably aromatic epoxide, alicyclic epoxide, aliphatic epixide and so forth. Preferable examples of the aromatic epoxide include di- or poly-glycidyl ether produced by reaction of polyvalent phenol having at least one aromatic nucleus or its alkylene oxide adduct with epichlorohydrin, and examples thereof include bisphenol-A, and di- or poly-glycidyl ether of its alkylene-oxide adduct; hydrogen-added bisphenol-A, and di- or poly-glycidyl ether of its alkylene-oxide adduct; novolac-type epoxy resin or the like. The alkylene oxide can typically be exemplified by ethylene oxide, propylene oxide or the like.

Preferable examples of the alicyclic epoxide are such as those obtained by epoxidating compound having at least one cycloalkane ring such as cyclohexene, cyclopentene or the like, using an appropriate oxidant such as hydrogen peroxide and peracid. Compounds containing cyclohexane oxide or cyclopentene oxide are preferable.

Preferable examples of the aliphatic epoxide include aliphatic polyvalent alcohol, di- or polyglycidyl ether of its alkylene-oxide adduct and the like, and representatives thereof include diglycidyl ether of alkylene glycol such as diglycidyl ether of ethylene glycol, diglycidyl ether of propylene glycol, and diglycidyl ether of 1,6-hexanediol; polyglycidyl ether of polyhydric alcohol such as di- or tri-glycidyl ether of glycerin or its alkylene-oxide adduct; diglycidyl ether of polyethylene glycol or itsalkylene-oxide adduct; and diglycidyl ether of polypropylene glycol or its alkylene-oxide adduct. The alkylene oxide herein can be exemplified by ethylene oxide, propylene oxide and the like.

Of these epoxides, the aromatic epoxide and alicyclic epoxide are preferable in view of their rapid curing properties, and the alicyclic epoxide is particularly preferable. In the present invention, the epoxide may be used in a singular manner, or in a proper combination of two or more species.

Examples of the vinyl ether compound include di- or trivinyl ether compounds such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether, trimethylolpropane trivinyl ether or the like; and monovinyl ether compounds such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-O-propylene carbonate, dodecyl vinyl ether, diethylene glycol monovinyl ether, and octadecyl vinyl ether.

Of these vinyl ether compounds, di- or trivinyl ether compounds are preferable while taking curing property, adhesiveness and surface hardness into consideration, and in particular, divinyl ether compounds are preferable. In the present invention, the vinyl compounds may be used in a singular manner, or in a proper combination of two or more species.

The UV-curing ink applicable to the present invention preferably contains a cationic polymerizable monomer out of these monomers, which is unlikely to be affected by oxygen polymerization inhibition, and further preferably contain a compound having oxetane ring(s) in view of curing property. A combined system including an oxetane compound in an amount of 60 to 95% by mass, an oxirane-group-containing compound in an amount of 5 to 40% by mass, and a vinyl ether compound in an amount of 0 to 40% by mass is preferable in view of the curing property and jetting stability.

The oxetane compound refers to a compound having oxetane ring(s), and any publicly-known oxetane compounds, such as those disclosed in JP-Tokukai-2001-220526A and JP-Tokukai-2001-310937A for example, are available.

Use of compounds having five or more oxetane rings may, however, raise problems of degrading the handleability due to an excessively large viscosity of the composition, and of insufficient tackiness of the resultant cured product due to a raised glass transition point of the composition. The oxetane compounds used in the present invention are preferably such as those having one to four oxetane rings.

The compounds having a single oxetane ring can be exemplified by those expressed by the general formula (1).

(1)

[Chemical Formula 1]

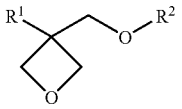

In the formula (1), R1 represents a hydrogen atom; $C_{1-6}$ alkyl group such as methyl group, ethyl group, propyl group, butyl group or the like; $C_{1-6}$ fluoroalkyl group; allyl group; aryl group; furyl group or thienyl group. R2 represents a $C_{1-6}$ alkyl group such as methyl group, ethyl group, propyl group, butyl group or the like; $C_{2-6}$ alkenyl group such as 1-propenyl group, 2-propenyl group, 2-methyl-1-propenyl group, 2-methyl-2-propenyl group, 1-butenyl group, 2-butenyl group, 3-butenyl group or the like; aromatic-ring-containing group such as phenyl group, benzyl group, fluorobenzyl group, methoxybenzyl group and phenoxybenzylethyl group; $C_{2-6}$ alkylcarbonyl group such as ethylcarbonyl group, propylcarbonyl group, butylcarbonyl group or the like; $C_{2-6}$ alkoxycarbonyl group such as ethoxycarbonyl group, propoxycarbonyl group, butoxycarbonyl group or the like; or $C_{2-6}$ N-alkylcabamoyl group such as ethyl carbamoyl group, propylcarbamoyl group, butylcarbamoyl group, pentylcarbamoyl group or the like. The oxetane compounds used in the present invention are preferably such as those having a single oxetane ring in view of obtaining a desirable tackiness of the resultant composition, and an excellent handleability by virtue of its low viscosity.

The compounds having two oxetane rings can be exemplified by those expressed by the general formula (2).

(2)

[Chemical Formula 2]

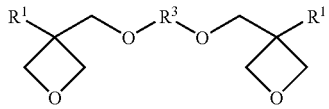

In the formula (2), R1 represents the groups same as those in the formula (1) in the above. R3 typically represents linear or branched alkylene group such as ethylene group, propylene group and butylene group; linear or branched poly (alkyleneoxy) group such as poly(ethyleneoxy) group, poly (propyleneoxy) group or the like; linear or branched unsaturated hydrocarbon group such as propenylene group, methylpropenylene group, butenylene group or the like; carbonyl group; carbonyl-group-containing alkylene group; carboxyl-group-containing alkylene group; or carbamoyl-group-containing alkylene group.

R3 may also be a polyvalent group selected from those expressed by the formulae (3), (4) and (5) below.

(3)

[Chemical Formula 3]

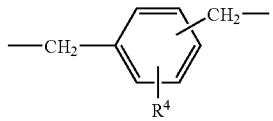

In the formula (3), R4 represents a hydrogen atom; $C_{1-4}$ alkyl group such as methyl group, ethyl group, propyl group, butyl group or the like; $C_{1-4}$ alkoxy group such as methoxy group, ethoxy group, propoxy group, butoxy group or the like; halogen atom such as chlorine atom, bromine atom or the like; nitro group; cyano group; mercapto group; lower alkoxycarboxyl group; carboxyl group; or carbamoyl group.

(4)

[Chemical Formula 4]

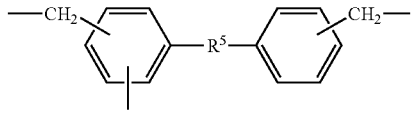

In the formula (4), R5 represents an oxygen atom, sulfur atom, methylene group, NH—, SO—, $SO_2$—, $C(CF_3)_2$— or $C(CH_3)_2$—.

(5)

[Chemical Formula 5]

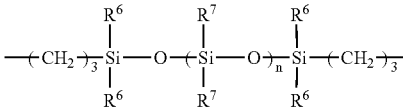

In the formula (5), R6 represents a $C_{1-4}$ alkyl group such as methyl group, ethyl group, propyl group, butyl group or the like; or aryl group, where n is an integer from 0 to 2,000. R7 represents a $C_{1-4}$ alkyl group such as methyl group, ethyl group, propyl group, butyl group or the like; or aryl group.

R7 represents a group selected from those expressed by the formula (6) below.

(6)

[Chemical Formula 6]

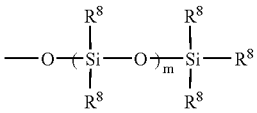

In the formula (6), R8 represents a $C_{1-4}$ alkyl group such as methyl group, ethyl group, propyl group, butyl group or the like; or aryl group, where m is an integer from 0 to 100.

Specific examples of the compounds having two oxetane rings are such as those expressed by the general formulae (7) and (8) below.

(7)

[Chemical Formula 7]

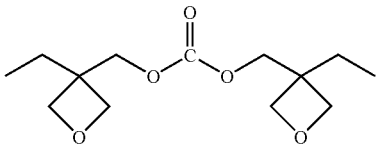

The compounds expressed by the formula (7) are such as those having an ethyl group as R1 and a carboxyl group as R3 in the formula (2).

(8)

[Chemical Formula 8]

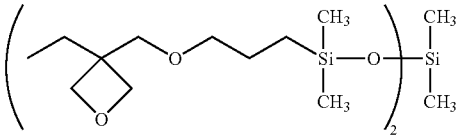

The compounds expressed by the formula (8) are such as those having an ethyl group as R1, and a substituent as R3 in the formula (2), the substituent is expressed by the formula (5), where of R6 and R7 represent a methyl group and n is 1.

In the compounds having two oxetane rings, other preferable examples besides those described in the above include those expressed by the general formula (9) below. In the formula (9), R1 represents the groups same as those in the formula (1) in the above.

(9)

[Chemical Formula 9]

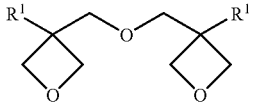

The compounds having three to four oxetane rings can be exemplified by those expressed by the general formula (10) below.

(10)

[Chemical Formula 10]

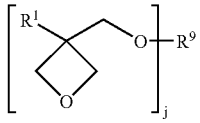

In the formula (10), R1 represents the groups same as those in the general formula (1) in the above. R9 represents a $C_{1-12}$ branched alkylene group such as those expressed by the formulae (11) to (13) below, a branched poly(alkyleneoxy) group expressed by the formula (14) below, a branched polysiloxane expressed by the formula (15) below, or the like, where j is 3 or 4.

(11)

[Chemical Formula 11]

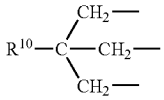

In the formula (11), R10 represents a lower alkyl group such as methyl group, ethyl group, propyl group or the like.

(12)

[Chemical Formula 12]

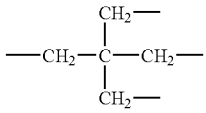

(13)

[Chemical Formula 13]

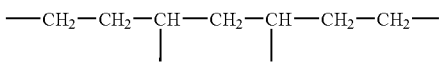

-continued (14)

[Chemical Formula 14]

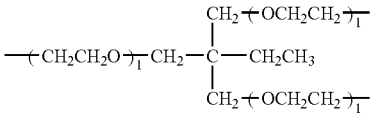

In the formula (14), l is an integer from 1 to 10.

(15)

[Chemical Formula 15]

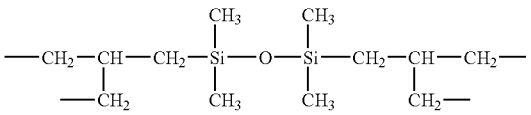

Specific examples of the compounds having three to four oxetane rings are such as those expressed by the general formula (16).

(16)

[Chemical Formula 16]

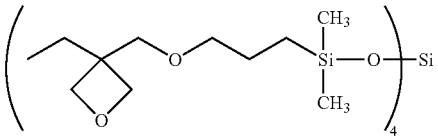

Other preferable examples of the compounds having one to four oxetane rings, besides those described in the above, include those expressed by the general formula (17) below.

(17)

[Chemical Formula 17]

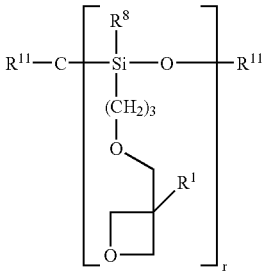

In the formula (17), R1 represents the groups same as those in the formula (1) in the above, and R8 represents the groups same as those in the formula (6). R11 represents a $C_{1-4}$ alkyl groups such as methyl group, ethyl group, propyl group, butyl group or the like; or a trialkylsilyl group, where r is 1 to 4.

Preferred examples of the oxetane compound available in the present invention will be shown below.

(18)

[Chemical Formula 18]

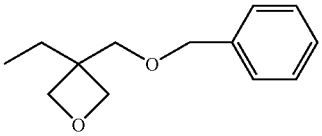

(19)

[Chemical Formula 19]

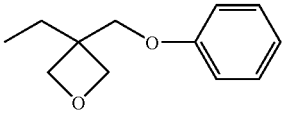

(20)

[Chemical Formula 20]

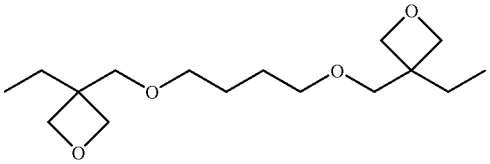

There is no special limitation on a method of producing these compounds having oxetane ring(s), and any known methods can be followed. One proposed production method is a synthetic method of oxetane ring from diol typically disclosed by Pattison (D. B. Pattison, J. Am. Chem. Soc., 3455, 79(1957). Other available compounds include those having a molecular weight of approximately 1,000 to 5,000, and one to four oxetane rings.

The followings can be exemplified as these compounds.

(21)

[Chemical Formula 21]

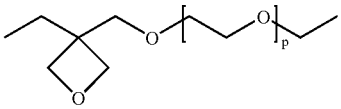

where, p is 20 to 200.

(22)

[Chemical Formula 22]

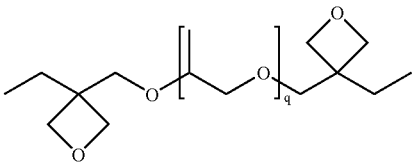

where, q is 15 to 100.

(23)

[Chemical Formula 23]

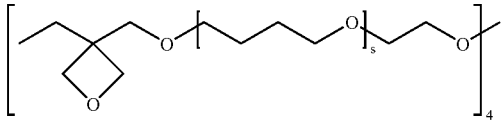

where, s is 20 to 200.

The photo-radical initiator may be any publicly-known initiators such as aryl alkyl ketone, oxime ketone, thiobenzoic acid S-phenyl, titanocene, aromatic ketone, thioxanthone, benzyl and quinone derivatives, ketocoumarins or the like. The initiator is detailed in "UV·EB Koka Gijutsu no Oyo to Shijo (Applications and Market of UV/EB Curing Technology)", published by CMC Publishing Co., Ltd., supervised by Yoneho Tabata, edited by Radtech Japan). Among others, acylphosphine oxide and acylphosphonate are high in the sensitivity, and can reduce its absorption due to photo-cleavage, so that they are especially effective for internal curing within an ink image of 5 to 12 μm thick per color as in the ink jet system. More specifically, bis(2,4,6-trimethylbenzoyl)-phenylphosphine oxide, bis(2,6-dimethoxybenzoyl)-2,4,4-trimethyl-pentylphosphine oxide or the like is preferable.

As the photo-cationic initiator, those typically used for chemical amplification photoresist or photo-cationic polymerization is available (see "Imejingu-you Yuki Zairyou (Organic Materials for Imaging)", edited by The Japanese Research Association for Organic Electronics Materials, published by BUN-SHIN (1993), p.187-192; and photo-acid generator described in "Hikari Koka Gijutsu (Photo-Curing Technology)", edited by Technical Information Institute Co., Ltd. (2001)). Examples of the compounds preferably used for the present invention will be listed below. First examples relate to $B(C_6F_5)_4^-$, $AsF_6^-$, $SbF_6^-$ and $CF_3SO_3^-$ salts of aromatic onium compounds such as diazonium, ammonium, iodonium and sulfonium compounds. Those having a borate compound as a counter anion are preferable in view of a large acid generating property. Specific examples of the onium compounds are shown below.

[Chemical Formula 24]

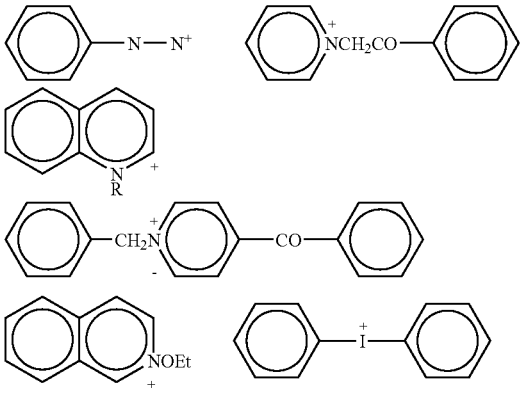

-continued

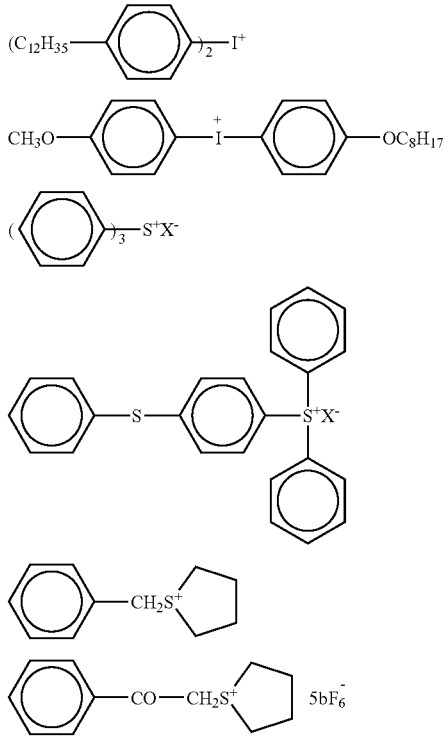

Second examples relate to sulfonated compounds capable of generating sulfonic acid. Specific examples of the compounds will be shown below.

[Chemical Formula 25]

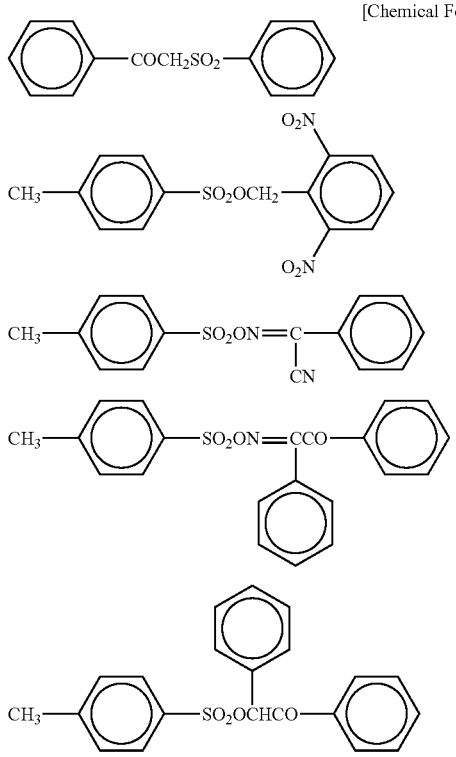

-continued

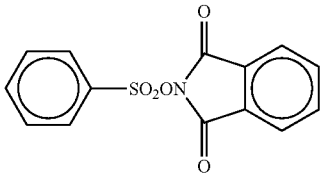

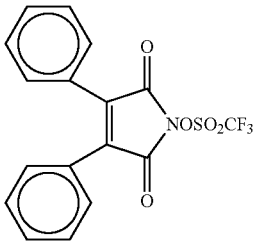

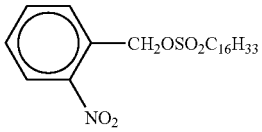

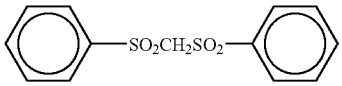

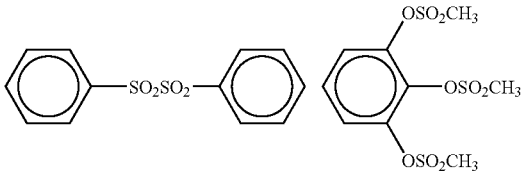

Third examples relate to halogenated compounds capable of generating hydrogen halide. Specific examples of the compounds will be shown below.

[Chemical Formula 26]

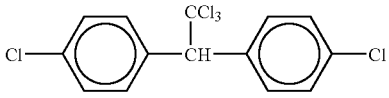

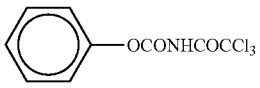

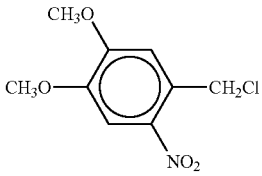

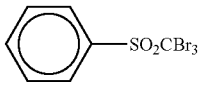

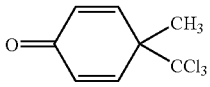

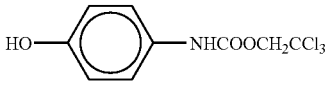

-continued

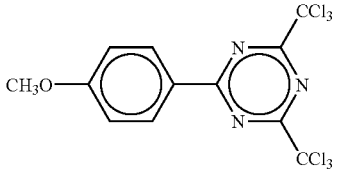

Fourth examples relate to iron-allene complexes.

[Chemical Formula 27]

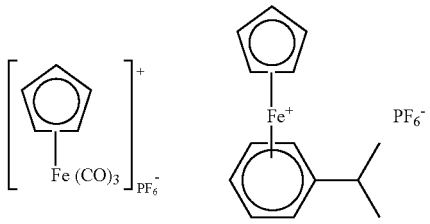

Preferable examples selected in view of safety, similarly to the aforementioned monomers, include 1-hydroxycyclohexyl phenyl ketone, 2-methyl-1-[4-(methylthio)phenyl]-2-morpholinopropane-1-one, bis(2,6-dimethoxybenzoyl)-2,4,4-trimethyl-pentylphosphine oxide, 2-hydroxy-2-methyl-1-phenyl-propane-1-one (Darocure (R) 1173). In a photocationic initiator, aromatic onium salt is decomposed to release benzene, so that in view of safety, aromatic onium salt having substituted aryl base is preferably used. The amount of addition is preferably 1 to 6% by mass of the entire ink composition, and is more preferably 2 to 5% by mass. In the present invention, it is preferable to carry out two-step irradiation under different wavelengths and intensities in view of raising the adhesiveness and traceability of the ink film to the recording medium P, and it is also preferable to use two or more initiators which differ in the absorption wavelength in combination.

Polymerizable oligomers can also be blended similarly to the polymerizable monomers. Examples of the polymerizable oligomer include epoxide acrylate, polyester acrylate, straight-chain acryl oligomer or the like.

Beside these additives, it is also allowable to add, if necessary, surfactant; leveling agent; matting agent; and film property adjusting material such as polyester-base resin, polyurethane-base resin, vinyl-base resin, acrylic resin, rubber-base resin, waxes, various types of polymerization inhibitor such as AO agent, amine or the like, lubricant and molding lubricant. Addition of a trace amount of organic solvent is also successful in improving the adhesiveness with the recording medium P. In view of VOC, organic solvent is not preferable by nature, however, the addition in this case is preferably within a range not causative of any problems in solvent resistance and VOC, and the amount is preferably within a range from 0.1 to 5%, and more preferably from 0.1 to 3%.

The ultraviolet curable ink of the present invention preferably has a viscosity at 25° C. of 7 to 50 mPa·s, in view of ensuring stable jetting irrespective of curing environment (temperature, humidity), and ensuring a desirable reproducibility and curing property.

For the case where a transparent material is applied to the recording medium P in the present invention, it is preferable to use white ink in order to raise the hiding power of colors on the recording medium P. Use of the white ink is preferable in particular for printing on flexible packages and labels, but there is of course a limitation on the amount of use thereof in view of the aforementioned jetting stability, and curling or cockling of the recording medium P.

Color materials available for the present invention may any of those soluble or dispersible in main component of the polymerizable compound, where pigment is preferable in view of weatherability. Examples of the pigment preferably be used in the present invention are listed below.

C.I.Pigment Yellow-1, 3, 12, 13, 14, 17, 74, 81, 83, 87, 95, 109, 138, 139, 151, 180;

C.I.Pigment Orange-16, 36, 38;

C.I.Pigment Red-5, 22, 38, 48:1, 48:2, 48:4, 49:1, 53:1, 57:1, 63:1, 101, 122, 144, 146, 185,;

C.I.Pigment Violet-19, 23;

C.I.Pigment Blue-15:1, 15:3, 15:4, 18, 27, 29, 60;

C.I.Pigment Green-7, 36;

C.I.Pigment White-6, 18, 21; and

C.I.Pigment Black-7.

Organic solvent or polymerizable compound are applicable as a dispersion medium for dispersing the above-described pigments. The ink applicable to the present invention is jetted from a jet opening, and cures immediately after being placed on the recording medium P, so that too much organic solvent contained as the dispersion medium may result in degradation or odor emission of the recording medium P due to residual portion of the solvent remained in the cured ink. It is therefore preferable for the ink applicable to the present invention to contain no organic solvent or only a suppressed amount of the organic solvent, and instead, to use the polymerizable compound as a major component of the dispersion medium. As the above-described polymerizable compound, it is more preferable to use a monomer having a lowest level of viscosity among any publicly-known monomers, in view of aptitude for the dispersion.

It is also allowable to add a dispersion aid for the dispersion of the pigment in order to enhance efficiency of dispersion of the pigment into the dispersion medium. Polymer dispersion aids are preferably used as the dispersion aid, where those of Solsperse Series manufactured by AVECIA Ltd., for example, are applicable. It is also allowable to use, as a dispersion auxiliary, a synergist corresponded to the individual pigments. These dispersion aid and dispersion auxiliary are preferably used in an amount of 1 to 50 parts by mass relative to 100 parts by mass of the pigment.

Dispersion of the pigment is preferably carried out so as to adjust the mean particle size of the pigment particles within a range from 0.08 to 0.5 μm. The mean particle size of the pigment particles exceeding 0.5 μm raises a problem of lowering of ink transmissivity, and degradation of image quality formed on the recording medium P. On the other hand, the mean particle size lower than 0.08 μm raises a problem of increasing costs for blending of the ink.

Maximum particle size of the pigment particles is preferably adjusted to a range from 0.3 to 10 μm, and more preferably from 0.3 to 3 μm. The maximum particle size of the pigment particles exceeding 10 μm raises a problem that the ink tends to clog within the jet opening. On the other hand, the maximum particle size less than 0.3 μm raises a problem of increase in the cost for blending of the ink.

Selection of the pigment, dispersion aid and dispersion medium, and setting of conditions for the dispersion and filtration, which are required for blending of the ink, are appropriately carried out so as to adjust the mean particle size and maximum particle size to the above-described ranges. This particle size control is successful in suppressing clogging of the head nozzles, and in keeping desirable levels of storage stability of the ink, transparency of the ink, and curing sensitivity.

The ink of the present invention preferably has a color material concentration of 1 to 10% by mass relative to the entire part of the ink. The color material concentration less than 1% by mass raises a problem that the ink does not effectively develop its color on the recording medium P, and the formed image becomes unclear. On the other hand, the color material concentration exceeding 10% by mass raises a problem that the ink cannot rapidly be cured on the recording medium P, and the strength and quality of the image are degraded.

Next, operations of an image recording apparatus 1 during the image formation will be described.

First, a user enters conditions for the image formation through an input section 11 to thereby command start of the image formation. Based on the input, a control device 10 controls a drive source 12 of a carrying device to carry the recording medium P to a predetermined position. Once the recording medium P is carried to the predetermined position, the control device 10 identifies a type of the recording medium P to be used. The control device 10 then selects an appropriate image recording condition from a plurality of image recording conditions preliminarily stored in a storing section 13. For example, for a condition with a high image recording speed, the amount of ink to be jetted is reduced, and for a condition with a low image recording speed, the amount of ink to be jetted is increased. Based on the read-out image recording condition, the control device 10 controls a carriage drive source 51, a drive source 12, a recording head 2 and an ink heater 22, to allow the ink adjusted to an optimum temperature to be jetted from the recording head 2 while carrying the recording medium P at an optimum carrying speed, and to irradiate the placed ink with ultraviolet radiation to thereby allow the ink to be cured and fixed for image formation. In this image recording method, high quality images can be obtained.

As is described in the above, according to the image recording apparatus 1 and the image recording method of the present embodiment, the maximum amount of ink to be jetted is appropriately changeable corresponding to the recording modes having different image recording speeds. Therefore, for the recording mode with a high image recording speed in comparison to the normal speed, the total amount of ink is limited, enabling to obtain a sufficient ink curing property with a small amount of light irradiation without decreasing the image recording speed. Accordingly, the image recording apparatus which can obtain high quality images, and the image recording method thereof can be realized.

In this embodiment, the maximum amount of ink to be jetted is decreased for a recording mode with a high image recording speed, and the maximum amount of ink to be jetted is increased for a recording mode with a low image recording speed, in the recording modes. Therefore, the operations and effects of the first aspect of the present invention can be realized more certainly.

Further, even in the case that the image recording apparatus is the serial print type or the like as in this embodiment, in which the recording head and the UV irradiation device are mounted on the same carriage and the irradiation device has to be small, the maximum amount of ink to be jetted is appropriately changeable corresponding to the plurality of recording modes with different image recording speeds. Thus, for the recording mode with a high image recording speed in comparison to the normal speed, the total amount of ink is limited, enabling to obtain a sufficient ink curing property with a small amount of light irradiation without decreasing the image recording speed.

Furthermore, in the case of comprising four or more recording heads for jetting four colors of inks of yellow, magenta, cyan and black, and forming an image by jetting the inks from the recording heads so as to cause almost no gap onto the recording medium, or forming an solid image, the total amount of ink to be jetted of single color or a plurality colors of not less than 5 g/m$^2$ is needed. Thus, the total amount of ink to be jetted is set to be an appropriate amount which is not less than 5 g/m$^2$ corresponding to the recording modes, and a ratio of amounts of inks of individual colors to be jetted is set. For example, the total amount of ink to be jetted is decreased in the recording mode with a high image recording speed in comparison to the recording mode with a low image recording speed. Moreover a ratio of amounts of inks of individual colors to be jetted is changed. Therefore, a sufficient ink curing property can be obtained with a small amount of light irradiation, enabling to improve an ink blurring, adhesiveness to a base material, wrinkles or the like even during the high speed recording.

In a high speed recording mode in an earlier technique, the amount of ink which is jetted on each pixel before UV exposure is large, resulting in obtaining insufficient amount of UV exposure, deterioration of the inner curing property, processing of ink curing only on the outer portion, or the like. Thereby, the problem would occur such as deterioration of inner curing property and poor adhesiveness of ink, generation of wrinkles or the like. However, the limit amount of ink is appropriately adjusted corresponding to the recording speeds in the configuration of this embodiment, so that the ink blurring, the adhesiveness to a base material can be improved, and wrinkles can be decreased.

It is to be understood that this invention is not limited to the above embodiment, and changes may be appropriately made.

Figure 3A:
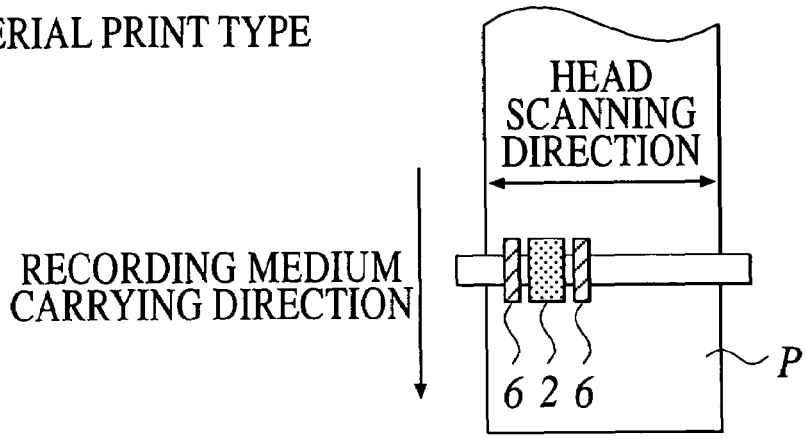
FIGS. 3A, 3B and 3C are views showing examples of an ink jet recording system which can be employed in the present invention.
Figure 3B:
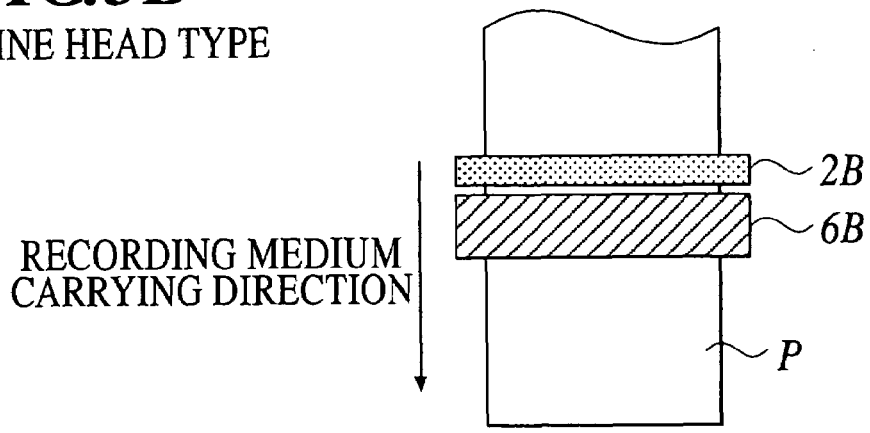

For example, the image recording apparatus in the embodiment is a serial print type image recording apparatus as shown in FIGS. 1 and 3A, however, a line print type image recording apparatus as shown in FIG. 3B may be employed. The line print type image recording apparatus comprises a line print type recording head (line head) 2B disposed in a width direction of the recording medium P, and ink is jetted from the recording head 2B and UV irradiation is performed by an irradiation device 6B disposed on the downstream side of the recording head 2B in a carrying direction, while carrying the recording medium P. A flat bed print type image recording apparatus shown in FIG. 3C may also be employed. In the flat bed print type image recording apparatus, ink is jetted from a recording head 2C and UV irradiation is performed by an irradiation device 6C, while carrying a paper P in a direction of an arrow shown in the figure. Thereafter, ink is jetted from the recording head 2C and UV irradiation is performed by the irradiation device 6C, while carrying the paper P in a direction opposite to the arrow shown in the figure. After the reciprocating movement of the recording medium P as described above, the recording head 2C is scanned in a sub scanning direction. The above operations are repeated to record an image.

As described above, even in the case of applying the line print type image recording apparatus, the maximum amount of ink to be jetted is appropriately changeable corresponding to the plurality of recording heads with different image recording speeds, so that the total amount of ink is limited in a recording mode with a high image recording speed compared to the normal speed. Thus, a sufficient ink curing property can be obtained with a small amount of light irradiation without decreasing the image recording speed.

As described above, even in the case of applying the flat bed print type image recording apparatus, in which the recording head and the UV irradiation device are mounted on the same carriage, the maximum amount of ink to be jetted is appropriately changeable corresponding to the plurality of recording modes with different image recording speeds. Thus, for the recording mode with a high image recording speed compared to the normal speed, the total amount of ink to be jetted is limited, enabling to obtain a sufficient ink curing property with a small amount of light irradiation without decreasing the image recording speed.

Explanations will be given with examples of the present invention below, however, the present invention is not limited thereto.

FIRST EXAMPLE

First, an explanation will be given where the image recording apparatus is the serial print type.

<<Ink Preparation>>

Each color of inks with the compositions described in the table of FIG. 4 is prepared.

For the ink preparations, Solsperse 24000 manufactured by AVECIA Ltd. is added in an amount of 15% by mass of pigment as a pigment dispersant to be dispersed by a sand mill. Thereafter, an initiator is added to be filtered through a membrane filter of 0.8 μm. Details of each abbreviation in the table of FIG. 4 are explained below.

K: deep black ink
C: deep cyan ink
M: deep magenta ink
Y: deep yellow ink
Color Material 1: C.I.Pigment Black-7
Color Material 2: C.I.Pigment Blue-15:3
Color Material 3: C.I.Pigment Red-122
Color Material 4: C.I.Pigment Yellow-74
Epoxy Composition: Celoxide 2021P manufactured by DAICEL CHEMICAL INDUSTRIES, LTD.
Oxetan Composition: OXT-212 manufactured by TOAGOSEI CO.,LTD.
Oxetan Composition: OXT-221 manufactured by TOAGOSEI CO.,LTD.
Initiator: SP152 manufactured by ASAHI DENKA Co., Ltd.

<<Image Recording Apparatus>>

An ink jet printer of the serial print type configured as shown in FIG. 1 is used. Four colors of inks prepared as described above are filled in the carriage, and a UV irradiation lamp is arranged at each end of the carriage.

As ink jet nozzles, a piezo-type head which has a nozzle pitch of 360 dpi and is variable in droplet size within the range of 4 to 28 pl is used. Droplet size is 4-28 pl per pixel for the nozzle pitch of 360 dpi, and 4 to 12 pl per pixel for the nozzle pitch of 720 dpi. "Dpi" in the present invention denotes the number of dots per 2.54 cm. The printer is set such that the total amount of ink for forming an solid image is 5.9 g/m$^2$ or more in the case that the nozzle pitch is 720 dpi, and 5.6 g/m$^2$ or more in the case that the nozzle pitch is 360 dpi. Specific gravity of the ink is around 1.01 to 1.02, that is nearly equal to 1, so that a number indicated in "ml/m$^2$" is identified with that in "g/m$^2$".

As the UV irradiation lamp arranged in each end of the carriage, a hot cathode fluorescent tube having a main perk at 254 nm is used. Illumination of the light source is set to be 3 mW/cm$^2$ on the surface of the base material (recording medium), and irradiation width is set to be 200 mm. All the modes are performed by a bi-directional printing.

<Image Formation>

Each image is formed according to the recording conditions in the table of FIG. 5.

As the recording condition, resolution has two steps of 360 dpi and 720 dpi, the number of pass has three steps of 2, 4 and 8, droplet amount has three steps of 8, 12 and 28 pl/pixel, carriage speed has two steps of 95 and 280 mm/s.

As the limit amount of ink, the amount of ink applied for a 100% solid image is set to be 100% for converting an ink liquid amount to a percentage.

In the recording condition 1, an image is recorded under the following conditions. The resolution is 720 dpi, the number of pass is 8, the droplet amount is 8 pl/pixel, the limit amount of ink is 400%, the maximum amount of ink adhesion on the four-color solid area is 23.6 ml/m$^2$, and the carriage speed is 280 mm/s.

In the recording condition 2, an image is recorded under the following conditions. The resolution is 720 dpi, the number of pass is 8, the droplet amount is 12 pl/pixel, the limit amount of ink is 400%, the maximum amount of ink adhesion on the four-color solid area is 35.4 ml/m$^2$, and the carriage speed is 280 mm/s.

In the recording condition 3, an image is recorded under the following conditions. The resolution is 720 dpi, the number of pass is 8, the droplet amount is 12 pl/pixel, the limit amount of ink is 250%, the maximum amount of ink adhesion on the four-color solid area is 22.1 ml/m$^2$, and the carriage speed is 280 mm/s.

In the recording condition 4, an image is recorded under the following conditions. The resolution is 720 dpi, the number of pass is 4, the droplet amount is 8 pl/pixel, the limit amount of ink is 400%, the maximum amount of ink adhesion on the four-color solid area is 23.6 ml/m$^2$, and the carriage speed is 280 mm/s.

In the recording condition 5, an image is recorded under the following conditions. The resolution is 720 dpi, the number of pass is 4, the droplet amount is 8 pl/pixel, the limit amount of ink is 250%, the maximum amount of ink adhesion on the four-color solid area is 14.8 ml/m$^2$, and the carriage speed is 280 mm/s.

In the recording condition 6, an image is recorded under the following conditions. The resolution is 360 dpi, the number of pass is 4, the droplet amount is 28 pl/pixel, the limit amount of ink is 400%, the maximum amount of ink adhesion on the four-color solid area is 22.4 ml/m$^2$, and the carriage speed is 95 mm/s.

In the recording condition 7, an image is recorded under the following conditions. The resolution is 360 dpi, the number of pass is 2, the droplet amount is 28 pl/pixel, the limit amount of ink is 400%, the maximum amount of ink adhesion on the four-color solid area is 22.4 ml/m$^2$, and the carriage speed is 95 mm/s.

In the recording condition 8, an image is recorded under the following conditions. The resolution is 360 dpi, the number of pass is 2, the droplet amount is 28 pl/pixel, the limit amount of ink is 300%, the maximum amount of ink adhesion on the four-color solid area is 16.8 ml/m$^2$, and the carriage speed is 95 mm/s.

Evaluation of image recording in the recording conditions 1 to 8 is made for each item below.

<Ink Blurring>

A: no ink blurring among colors, and smooth gradation;

B: slight ink blurring among colors, and a portion of gradation rough; and

C: ink blurring observed among colors, and rough gradation remarkably observed.

<Adhesiveness to Base Material>

A: excellent adhesiveness to the base material on the four-color solid area on which the largest amount of ink is used;

B: slightly degraded adhesiveness to the base material on the four-color solid area; and C: decreased inner portion curing property on the four-color solid area, and degraded adhesiveness to the base material.

<Wrinkle>

A: no wrinkle even on the four-color solid area on which the largest amount of ink is used;

C: wrinkle generated on the four-color solid area on which the largest amount of ink is used; and Results of the evaluation were listed in table of FIG. 5.

As shown in the table of FIG. 5, in the image recording apparatus of this example, when the recording mode is set such that the resolution is 720 dpi, the number of pass is 8, and the droplet amount is 8 pl/pixel (recording mode 1), the amount of ink to be jetted is not needed to be limited.

The limit amount of ink is efficient in a recording mode in which the number of pass is 4, and the image condition is excellent when the limit amount of ink is 250% (recording condition 5).

In case that the number of pass is 8 and the droplet amount is 12 pl/pixel (recording condition 3), the limit amount of ink is efficient.

The limit amount of ink is not necessary for the case where the resolution is 360 dpi, the number of pass is 4, the droplet amount is 28 pl/pixel (recording condition 6), however, the limit amount of ink is efficient when the number of pass is 2 (recording condition 8).

As described above, the amount of ink to be jetted is limited according to the recording modes, thereby improving the image condition.

SECOND EXAMPLE

Next, an explanation will be given where the image recording apparatus is the line print type. Preparation of ink is performed in the same manner as described in the first example, thus, the explanation thereof will be omitted here.

<<Image Recording Apparatus>>

An ink jet printer of the line print type configured as shown in FIG. 3B is used. Four colors of inks prepared in the same manner as described in the first example are filled in the carriage, and a UV irradiation lamp is arranged on the downstream side of the line head in the carrying direction of the recording medium. In FIG. 3B, there is shown only one line head, but four line heads shall be arranged in the carrying direction of the recording medium for jetting four colors of inks. Each of the recording heads corresponds to one of the four colors.

As ink jet nozzles, a piezo-type head which has a nozzle pitch of 360 dpi and is variable in droplet size within the range of 4 to 28 pl is used. Droplet size is 4 to 28 pl per pixel for the nozzle pitch of 360 dpi. The printer is set such that the total amount of ink for forming a solid image is 5.6 g/m$^2$ or more in the case that the nozzle pitch is 360 dpi.

As the UV irradiation lamp arranged on the downstream side of the line head in the carrying direction of the recording medium, a high pressure mercury vapor lamp in which illumination of the light source is set to be 30 mW/cm$^2$ on the surface of the base material (recording medium), and irradiation width in the carrying direction of the recording medium is set to be 300 mm.

<Image Formation>

Each image is formed according to the recording conditions in the table of FIG. 6.

As the recording condition, resolution is 360 dpi, the number of pass is 1, droplet amount is 28 pl/pixel, and line speed has two steps of 200 and 300 mm/s.

As the limit amount of ink, the amount of ink applied for a 100% solid image is set to be 100% for converting an ink liquid amount to a percentage.

In the recording condition 1B, an image is recorded under the following conditions. The resolution is 360 dpi, the number of pass is 1, the droplet amount is 28 pl/pixel, the limit amount of ink is 400%, the maximum amount of ink adhesion on the four-color solid area is 22.4 ml/m$^2$, and the line speed is 200 mm/s.

In the recording condition 2B, an image is recorded under the following conditions. The resolution is 360 dpi, the number of pass is 1, the droplet amount is 28 pl/pixel, the limit amount of ink is 400%, the maximum amount of ink adhesion on the four-color solid area is 22.4 ml/m$^2$, and the line speed is 300 mm/s.

In the recording condition 3B, an image is recorded under the following conditions. The resolution is 360 dpi, the number of pass is 1, the droplet amount is 28 pl/pixel, the limit amount of ink is 250%, the maximum amount of ink adhesion on the four-color solid area is 14.0 ml/m$^2$, and the line speed is 300 mm/s.

Evaluation of image recording in the recording conditions 1B to 3B is made in the same manner as in the first example.

Results of the evaluation were listed in table of FIG. 6.

As shown in the table of FIG. 6, in the image recording apparatus of this example, when the recording mode is set such that the resolution is 360 dpi, the number of pass is 1, the droplet amount is 28 pl/pixel, and the line speed is 200 mm/s (recording mode 1B), the amount of ink to be jetted is not needed to be limited.

In the recording mode in which the line speed is 300 mm/s, the amount of light irradiation is small due to the high line speed. Thus, when the amount of ink is not limited (recording condition 2B), poor curing of ink occurs, resulting in deterioration of image quality. However, when the limit amount of ink is limited to 250% (recording condition 3B), poor curing of ink does not occur, enabling to obtain high quality images. Therefore, it is considered that the limit amount of ink is efficient in the above recording mode.

As described above, the amount of ink to be jetted is limited corresponding to the recording modes, thereby improving the image condition.

THIRD EXAMPLE

Next, an explanation will be given where the image recording apparatus is the flat bed print type. Preparation of ink is performed in the same manner as described in the first example, thus, the explanation thereof will be omitted here.

<Image Recording Apparatus>

Figure 3C:
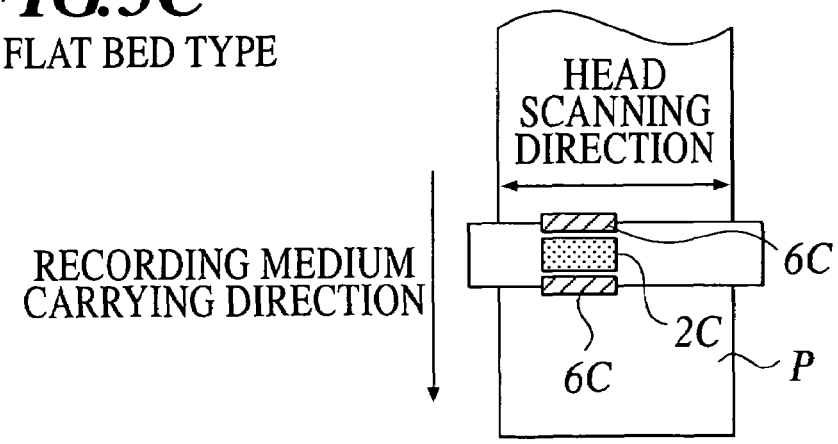

An ink jet printer of the line print type configured as shown in FIG. 3C is used. Four colors of inks prepared in the same manner as described in the first example are filled in the carriage, and a UV irradiation lamp is arranged on both sides of the carriage.

As ink jet nozzles, a piezo-type head which has a nozzle pitch of 360 dpi and is variable in droplet size within the range of 4 to 28 pl is used. Droplet size is 4 to 28 pl per pixel for the nozzle pitch of 720 dpi. The printer is set such that the total amount of ink for forming a solid image is 5.9 g/m$^2$ or more in the case that the nozzle pitch is 720 dpi.

As the UV irradiation lamp arranged on both sides of the carriage, a hot cathode fluorescent tube having a main perk at 254 nm is used as in the first example. Illumination of the light source is set to be 3 mW/cm$^2$ on the surface of the base material (recording medium), and irradiation width is set to be 200 mm in the carrying direction of the recording medium. All the modes are performed by a bi-directional printing.

<Image Formation>

Each image is formed according to the recording conditions in the table of FIG. 7.

As the recording condition, resolution is 720 dpi, the number of pass has two steps of 4 and 8, droplet amount is 28 pl/pixel, and base material speed is 200 mm/s.

As the limit amount of ink, the amount of ink applied for a 100% solid image is set to be 100% for converting an ink liquid amount to a percentage.

In the recording condition 1C, an image is recorded under the following conditions. The resolution is 720 dpi, the number of pass is 8, the droplet amount is 28 pl/pixel, the limit amount of ink is 400%, the maximum amount of ink adhesion on the four-color solid area is 35.4 ml/m$^2$, and the base material speed is 200 mm/s.

In the recording condition 2C, an image is recorded under the following conditions. The resolution is 720 dpi, the number of pass is 4, the droplet amount is 28 pl/pixel, the limit amount of ink is 400%, the maximum amount of ink adhesion on the four-color solid area is 35.4 ml/m$^2$, and the base material speed is 200 mm/s.

In the recording condition 3C, an image is recorded under the following conditions. The resolution is 720 dpi, the number of pass is 4, the droplet amount is 28 pl/pixel, the limit amount of ink is 250%, the maximum amount of ink adhesion on the four-color solid area is 22.1 ml/m$^2$, and the base material speed is 200 mm/s.

Evaluation of image recording in the recording conditions 1C to 3C is made in the same manner as in the first example.

Results of the evaluation were listed in table of FIG. 7.

As shown in the table of FIG. 7, in the image recording apparatus of this example, when the recording mode is set such that the resolution is 720 dpi, the number of pass is 8, the droplet amount is 28 pl/pixel, and the base material speed is 200 mm/s (recording mode 1C), the amount of ink to be jetted is not needed to be limited.

In the recording mode in which the number of pass is 4, the number of times that the irradiation device passes over the base material is reduced, so that irradiation time of light is reduced, thereby reducing the amount of light irradiation. Thus, when the amount of ink is not limited (recording condition 2C), poor curing of ink occurs, resulting in deterioration of image quality. However, when the limit amount of ink is limited to 250% (recording condition 3C), poor curing of ink does not occur, enabling to obtain high quality images. Therefore, it is considered that the limit amount of ink is efficient in the above recording mode.

As described above, the amount of ink to be jetted is limited corresponding to the recording modes, thereby improving the image condition.

The entire disclosure of Japanese Patent Applications No. Tokugan 2003-95470 which was filed on Mar. 31, 2003, and Japanese Patent Applications No. Tokugan 2004-29431 which was filed on Feb. 5, 2004, including specification, claims, drawings and summary are incorporated herein by reference in its entirety.

What is claimed is:

1. An image recording apparatus comprising:

a recording head of an ink jet system for jetting an ultraviolet curable ink on a recording medium to form an image; and an irradiation device for radiating an ultraviolet ray to the ink placed on the recording medium to cure and fix the ink, wherein the apparatus has a plurality of recording modes with different image recording speeds for changing a maximum amount of ink to be jetted corresponding to the plurality of recording modes, wherein the maximum amount of ink to be jetted is decreased for a recording mode with a high image recording speed, and the maximum amount of ink to be jetted is increased for a recording mode with a low image recording speed, in the plurality of recording modes, and wherein the maximum amount of ink to be jetted is determined by ink droplet size.

2. The apparatus of claim 1, wherein a recording type is a serial print type in which the recording head of the ink jet system and the irradiation device for radiating an ultraviolet ray are mounted on a same carriage.

3. The apparatus of claim 1, wherein a recording type is a line print type.

4. The apparatus of claim 1, wherein a recording type is a flat bed print type.

5. The apparatus of claim 1, wherein the apparatus comprising:

four or more recording heads for forming an image by jetting four colors of inks of yellow, magenta, cyan, and black, wherein a total amount of ink to be jetted of a single color or a plurality of colors necessary for forming an image by jetting the ink from the plurality of recording heads so as to generate almost no gap on the recording medium is 5 $g/m^2$ or more, and the total amount of ink to be jetted is set to be 5 $g/m^2$ or more and a ratio of amounts of inks of individual colors to be jetted is set, corresponding to the plurality of recording modes.

6. An image recording method comprising:

forming an image by jetting an ultraviolet curable ink on a recording medium from a recording head of an ink jet system; thereafter radiating an ultraviolet ray to the ink placed on the recording medium by an irradiation device to cure and fix the ink; and changing a maximum amount of ink to be jetted corresponding to a plurality of recording modes with different image recording speeds, wherein the maximum amount of ink to be jetted is decreased for a recording mode with a high image recording speed, and the maximum amount of ink to be jetted is increased for a recording mode with a low image recording speed, in the plurality of recording modes, and wherein the maximum amount of ink to be jetted is determined by ink droplet size.

* * * * *